US009297191B1

(12) United States Patent
Chen

(10) Patent No.: US 9,297,191 B1
(45) Date of Patent: Mar. 29, 2016

(54) HINGE

(71) Applicant: Wei-Chu Chen, Taichung (TW)

(72) Inventor: Wei-Chu Chen, Taichung (TW)

( * ) Notice: Subject to any disclaimer, the term of this patent is extended or adjusted under 35 U.S.C. 154(b) by 0 days.

(21) Appl. No.: 14/501,410

(22) Filed: Sep. 30, 2014

(51) Int. Cl.
*E05D 5/02* (2006.01)

(52) U.S. Cl.
CPC ..... *E05D 5/02* (2013.01)

(58) Field of Classification Search
CPC ..... E05D 5/0246; E05D 2005/0261; E05D 2005/0269; E05D 7/081; E05D 7/08; E05Y 2900/114; E05Y 2600/502; E05Y 2600/60; E05F 11/385; E06B 3/54; A47K 3/362; A47K 2003/367; A47F 3/12; A47F 3/125; Y10T 16/5326; Y10T 16/554; Y10T 16/547
See application file for complete search history.

(56) References Cited

U.S. PATENT DOCUMENTS 4,689,853 A * 9/1987 Marinoni ..... 16/382
5,867,869 A * 2/1999 Garrett et al. ..... 16/252
6,092,263 A * 7/2000 Boue et al. ..... 16/286
6,161,255 A * 12/2000 Garrett ..... 16/284
6,766,561 B1 * 7/2004 Cheng ..... 16/235
7,305,797 B2 * 12/2007 Chiang et al. ..... 49/388
8,578,556 B1 * 11/2013 Yu ..... 16/53
2002/0116787 A1 * 8/2002 Miller et al. ..... 16/252
2006/0207060 A1 * 9/2006 Cheng ..... 16/252
2009/0106937 A1 * 4/2009 Bai ..... 16/252
2010/0199459 A1 * 8/2010 Bacchetti ..... 16/54
2012/0216370 A1 * 8/2012 Chow ..... 16/54
2012/0279015 A1 * 11/2012 Hung ..... 16/297

* cited by examiner

*Primary Examiner* — Chuck Mah
(74) *Attorney, Agent, or Firm* — Trop Pruner & Hu, P.C.

(57) ABSTRACT

A hinge includes a connecting member, a first shaft member, a pivoting member, at least one shock absorber and a restoring unit. The first shaft member extends rotatably through the connecting member. The pivoting member is connected co-rotatably to the first shaft member, and is connected to the object. The pivoting member has at least one limiting surface facing the object. The shock absorber is disposed between the limiting surface of the pivoting member and the object for preventing collision between the pivoting member and the object. The restoring unit is disposed in the connecting member for driving rotation of the first shaft member toward a neutral position.

12 Claims, 14 Drawing Sheets

HINGE

FIELD OF THE INVENTION

The invention relates to a hinge, more particularly to a hinge that has shock absorbing means.

BACKGROUND OF THE INVENTION

Referring to FIG. 1, a conventional hinge disclosed in Taiwanese Utility Model Patent No. M412227 includes a connecting member 11, a pivoting member 12, a rotating shaft 13, a bolt 14, an abutment member 15, a resilient member 16, a seat member 17 and a throttle valve 19. The connecting member 11 is connected to a wall (not shown). The rotating shaft 13 extends rotatably through the connecting member 11. A central portion of the rotating shaft 13 is disposed in a first chamber 111 formed in the connecting member 11. The pivoting member 12 is connected to a door panel (not shown), and is connected co-rotatably to the rotating shaft 13 by the bolt 14. The seat member 17 is mounted in the connecting member 11. The abutment member 15 is disposed movably in the connecting member 11, extends movably into the seat member 17, and cooperates with the seat member 17 to define a second chamber 171 therebetween. The resilient member 16 is mounted in the seat member 17 to bias resiliently the abutment member 15 toward the central portion of the rotating shaft 13. The first and second chambers 111, 171 are filled with damping oil. The connecting member 11 is further formed with an oil passage 18 that communicates fluidly with the first and second chambers 111, 171. The throttle valve 19 is disposed in the connecting member 11 for adjusting the flow rate of the damping oil flowing through the oil passage 18.

When the pivoting member 12 is driven by an external force to rotate relative to the connecting member 11, the abutment member 15 is pushed by the central portion of the rotating shaft 13 to move away from the rotating shaft 13 against the resilient force of the resilient member 16. At this time, the damping oil in the second chamber 171 generates a retarding force to retard the movement of the abutment member 15, and is forced to enter the first chamber 111 through the oil passage 18. When the external force is removed, the abutment member 15 is biased by the resilient member 16 to move toward the rotating shaft 13, so as to drive the pivoting member 12 to rotate back to its original position. At this time, the damping oil in the first chamber 111 generates a retarding force to retard the movement of the abutment member, and is forced to enter the second chamber 171 through the oil passage 18.

The conventional hinge has the following drawbacks.

1. The door panel and the pivoting member 12 are usually made of stiff material. When opening or closing the door, the door panel may collide with the pivoting member 12 and may therefore be fractured.

2. The pivoting member 12 is connected to the rotating shaft 13 by the bolt 14, and may be loosed from the rotating shaft 13 easily.

3. A gap may be formed between the abutment member and the seat member 17 to affect the retarding force controlled by the throttle valve 19.

4. It is difficult to adjust the throttle valve 19 when the conventional hinge is placed inadequately, since the throttle valve 19 can only be adjusted at one side of the conventional hinge.

SUMMARY OF THE INVENTION

Therefore, the object of the present invention is to provide a hinge that alleviate at least one of the aforesaid drawbacks associated with the prior art.

Accordingly, a hinge of the present invention is adapted for interconnecting first and second objects, and includes a connecting member, a first shaft member, a pivoting member, at least one shock absorber and a restoring unit. The connecting member is adapted to be connected to the first object. The first shaft member extends along a first axis and through the connecting member, and is rotatable relative to the connecting member about the first axis. The pivoting member is connected co-rotatably to the first shaft member to be pivotable relative to the connecting member, and is adapted to be connected to the second object so that the second object is pivotable relative to the first object. The pivoting member has at least one limiting surface that faces the second object. The shock absorber is adapted to be disposed between the limiting surface of the pivoting member and the second object for preventing collision between the pivoting member and the second object. The restoring unit is disposed in the connecting member for driving rotation of the first shaft member toward a neutral position, so as to maintain the pivoting member at a normal position relative to the connecting member.

BRIEF DESCRIPTION OF THE DRAWINGS

Other features and advantages of the present invention will become apparent in the following detailed description of the embodiments with reference to the accompanying drawings, of which.

DETAILED DESCRIPTION OF THE EMBODIMENTS

Figure 1:
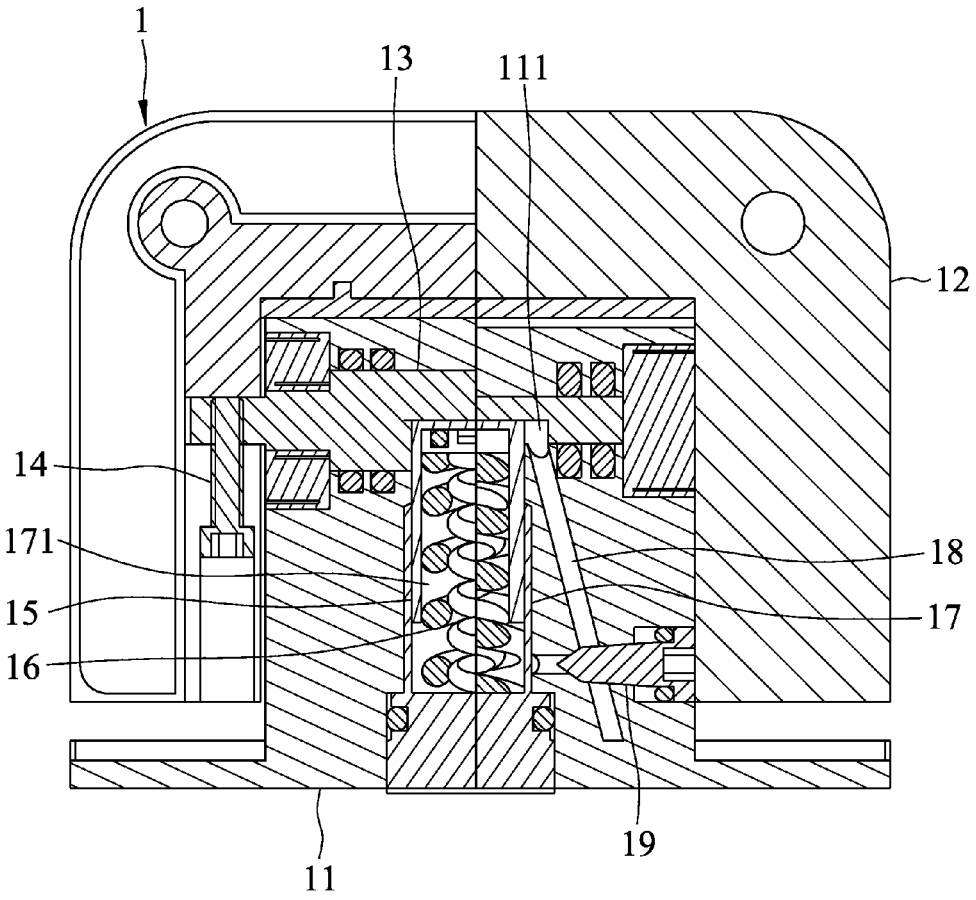
FIG.1 PRIOR ART
FIG. 1 is a sectional view of a conventional hinge disclosed in Taiwanese Utility Model Patent No. M412227.

Before the present invention is described in greater detail, it should be noted that like elements are denoted by the same reference numerals throughout the disclosure.

Figure 2:
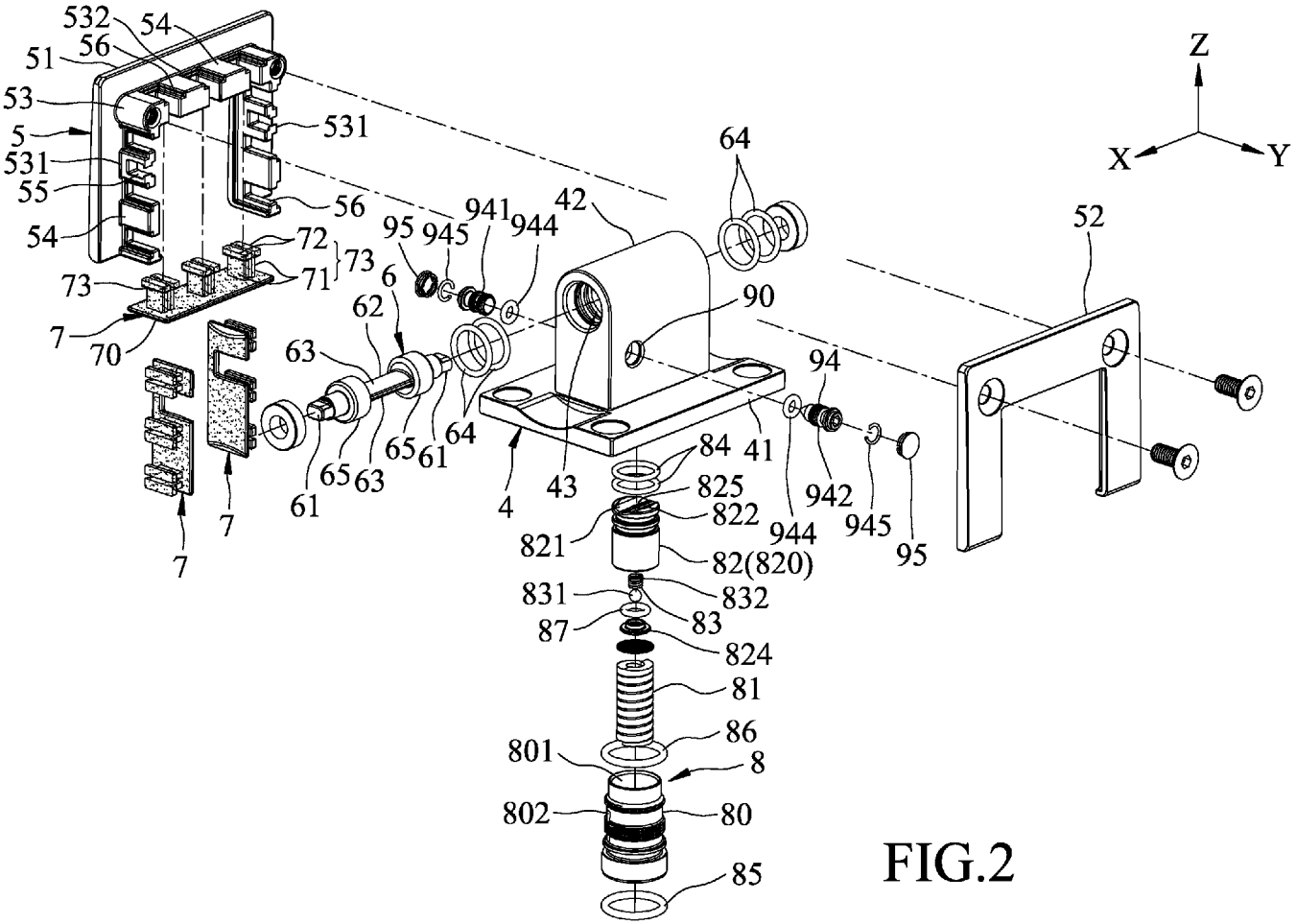
FIG. 2 is an exploded perspective view of a first embodiment of a hinge according to the invention.
Figure 3:
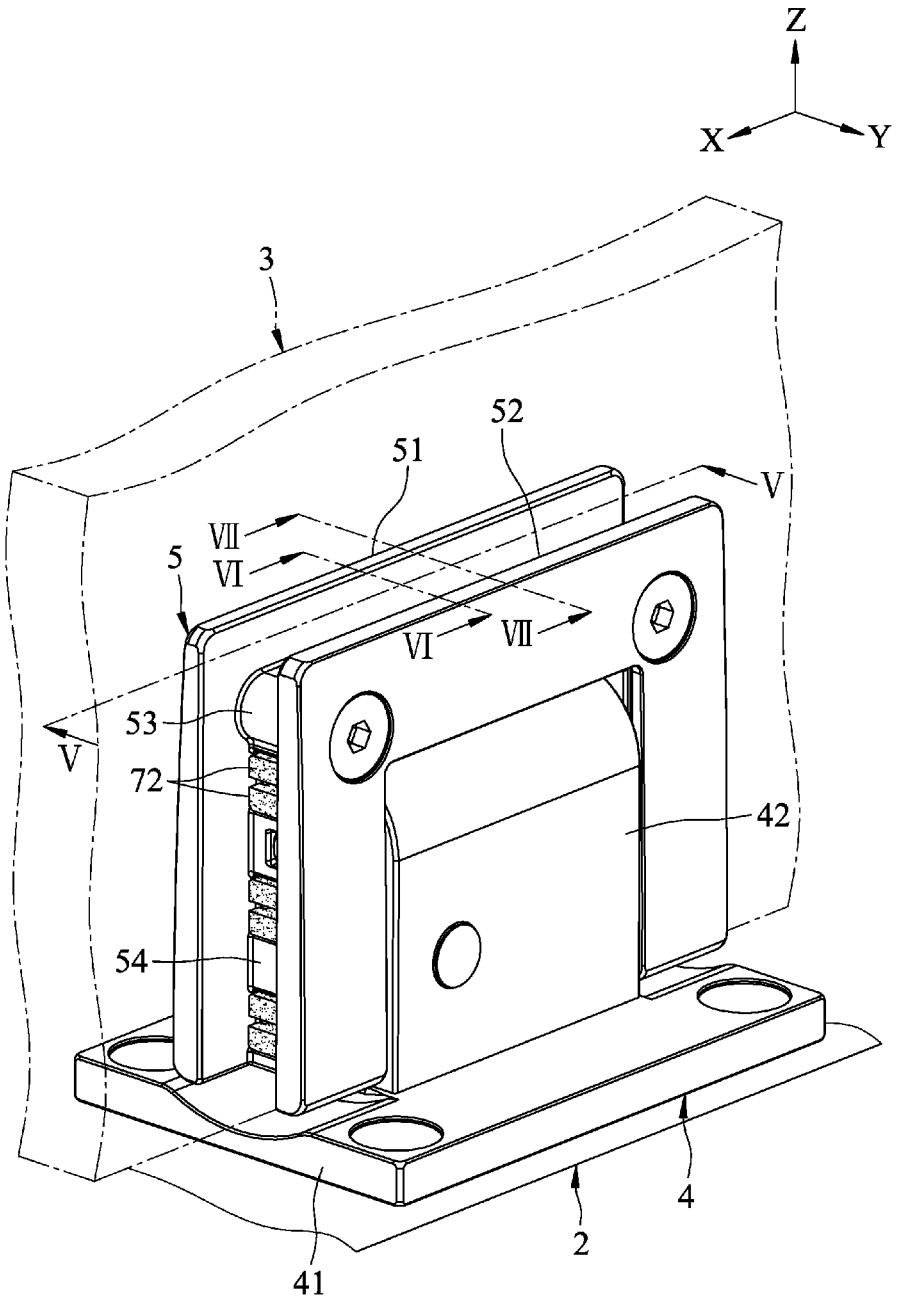
FIG. 3 is a schematic perspective view of the first embodiment.
Figure 4:
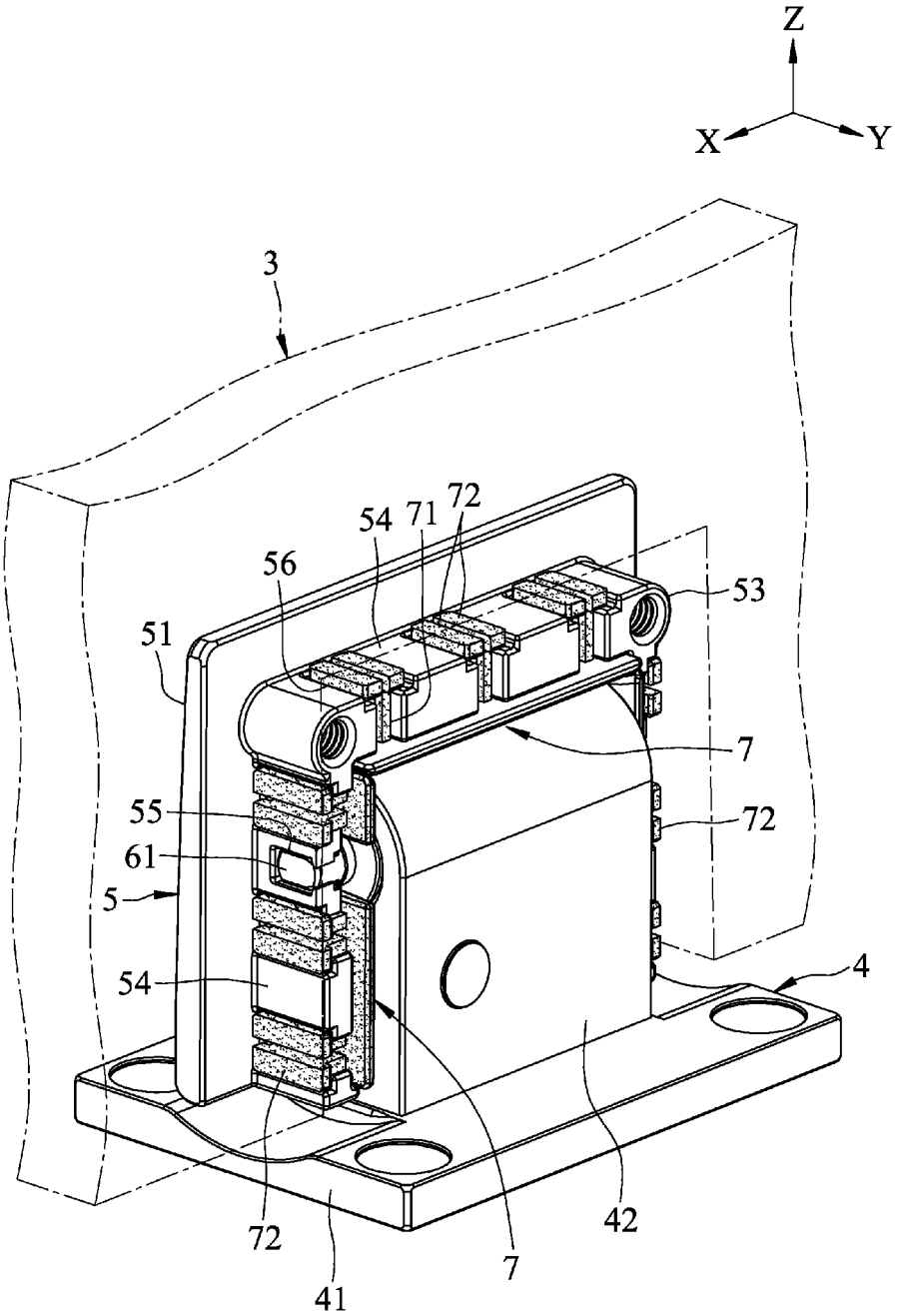
FIG. 4 is another schematic perspective view of the first embodiment in which a plate portion of a pivoting member is omitted.

As shown in FIGS. 2 to 4, a first embodiment of a hinge according to the present invention is adapted for interconnecting pivotally first and second objects 2, 3, and includes a connecting member 4, a pivoting member 5, a first shaft member 6, three cushion members 7, a restoring unit 8 and a damping unit 9. In this embodiment, the first object 2 is configured as a wall, and the second object 3 is configured as a door panel.

Figure 5:
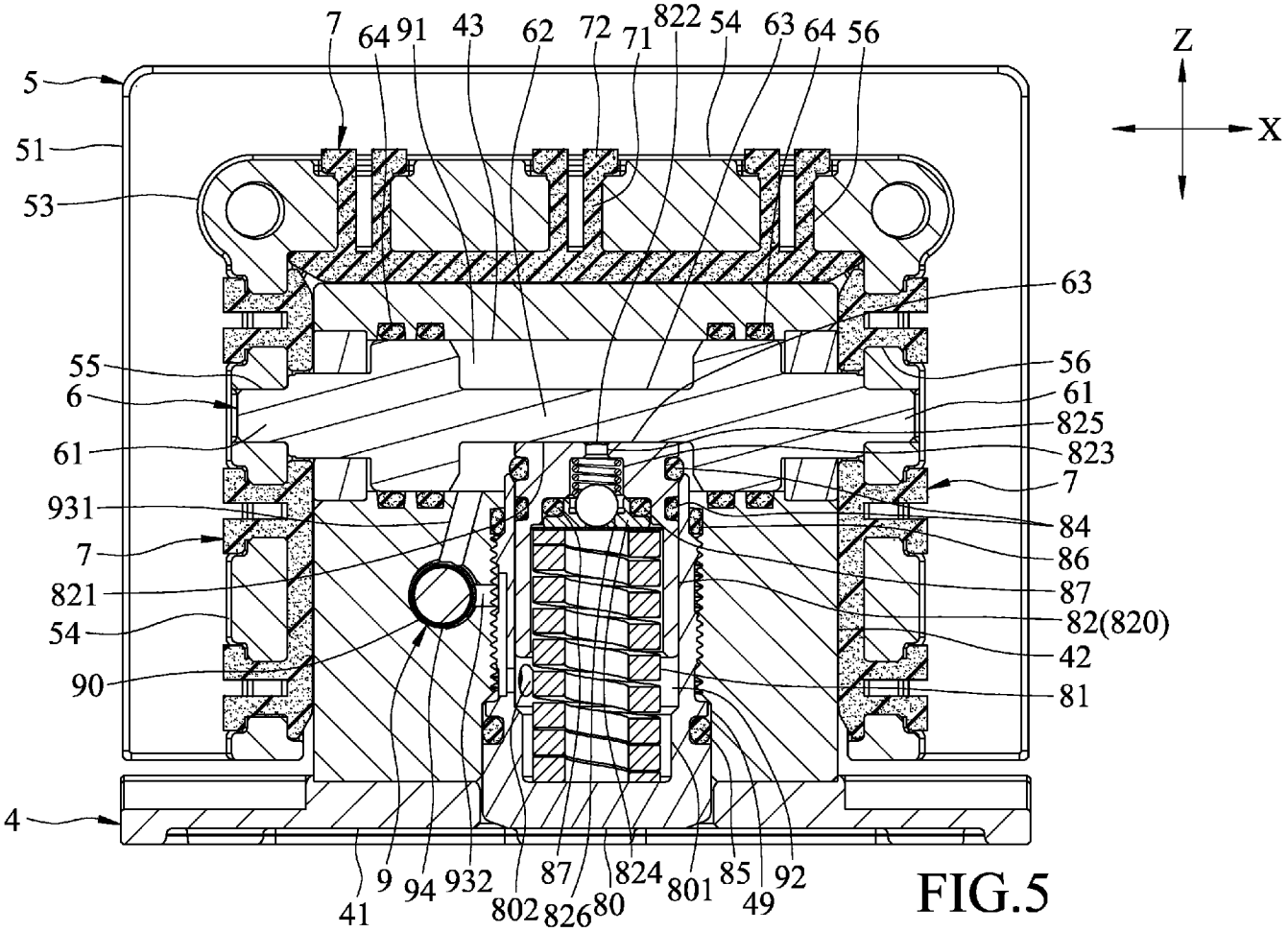
FIG. 5 is a sectional view of the first embodiment taken along line V-V in FIG. 3.

Referring further to FIG. 5, the connecting member 4 has a base portion 41 connected to the first object 2, a mount portion 42 extending from the base portion 41 and away from the first object 2, a shaft hole 43 formed through the mount portion 42 along a first axis (X), and a mount hole 49 (see FIG. 5) formed through the base portion 41, and communicating spatially the shaft hole 43.

The first shaft member 6 extends along the first axis (X) and through the shaft hole 43 of the connecting member 4, and is rotatable relative to the connecting member 4 about the first axis (X) . The first shaft member 6 has two opposite end portions 61 that are disposed along the first axis (X) and out of the connecting member 4, and a cam portion 62 that is disposed in the mount portion 42 and between the end portions 61. Each of the end portions 61 has a non-circular cross-section. The cam portion 62 has an elongate cross-section that has two diametrically-opposite long sides and two diametrically-opposite short sides. The cam portion 62 further has two diametrically-opposite cam surfaces 63 that respectively formed the long sides of the cross-section of the cam portion 62. In this embodiment, the cam surfaces 63 are configured to be convex.

The first shaft member 6 further has two connecting portions 65 each being connected between the cam portion 62 and a respective one of the end portions 61, and a plurality of shaft sealing rings 64 sleeved on outer surrounding surfaces of the connecting portions 65 for sealing a gap between one of the connecting portions 65 and an inner surrounding surface of the connecting member 4 that defines the shaft hole 43, and a gap between the other one of the connecting portions 65 and the inner surrounding surface.

The pivoting member 5 is connected to the second object 3, and has a main engaging portion 53 and two spaced-apart plate portions 51, 52. The main engaging portion 53 is adapted to engage an engaging portion of the second object 3. The plate portions 51, 52 are connected respectively to opposite sides of the main engaging portion 53 in the direction of a second axis (Y) perpendicular to the first axis (X), and cooperatively clamp the engaging portion of the second object 3 therebetween. In this embodiment, the main engaging portion 53 and one of the plate portions 51, 52 of the pivoting member 5 are formed as one piece.

The main engaging portion 53 is U-shaped, opens away from the second object 3, and has a pair of side sections 531 that are spaced apart from each other in the direction of the first axis (X), and a connecting section 532 that interconnects the side sections 531. Each of the side sections 531 and the connecting section 532 has a limiting surface 54 facing toward the second object 3, and a plurality of installation grooves 56 formed therethrough. Each of the installation grooves 56 of the side sections 531 and the connecting section 532 is formed through the corresponding limiting surface 54. Each of the side sections 531 is further formed with a non-circular insertion hole 55. The insertion holes 55 of the side sections 531 are aligned with each other along the first axis (X). Each of the end portions 61 of the first shaft member 6 is inserted fittingly into a respective one of the insertion holes 55, and is riveted or soldered to the pivoting member 5, such that the pivoting member 5 is co-rotatable with the first shaft member 6 and is pivotable relative to the connecting member 4 between a normal position (see FIG. 7) and an ultimate position (see FIG. 9), and that the second object 3 is pivotable relative to the first object 2. In this embodiment, each of the end portions 61 of the first shaft member 6 has a rectangular cross-section, and each of the insertion holes 55 is rectangular.

Referring back to FIG. 2, the three cushion members 7 are made of shock absorb material (e.g., rubber) and are mounted fixedly and respectively to the side sections 531 and the connecting section 532 of the main engaging portion 53 of the pivoting member 5. Each of the cushion members 7 has a base segment 70 that is disposed at one side of a respective one of the side sections 531 and the connecting section 532 opposite to the corresponding limiting surface 54, and that abuts against the respective one of the side sections 531 and the connecting section 532, and a plurality of engaging structures 73 that engage respectively the installation grooves 56 of the respective one of the side sections 531 and the connecting section 532. For each of the cushion members 7, each of the engaging structures 73 includes a pair of spaced-apart resilient arms 71 that extend from the base segment 70 and through the corresponding installation groove 56, and a pair of cushion segments 72 that extend respectively from distal ends of the resilient arms 71 and away from each other, and that abut against the corresponding one of the side sections 531 and the connecting section 532. Each of the cushion segments 72 has a portion that protrudes out of the corresponding limiting surface 54 to serve as a shock absorber, so as to prevent collision between the pivoting member 5 and the second object 3.

The restoring unit 8 is disposed in the connecting member 4, and includes a seat member 80, a resilient member 81, an abutment member 82, a check valve 83, a plurality of barrel sealing rings 84, a plurality of seat sealing rings 85, 86 and a channel sealing ring 87.

The seat member 80 is substantially disposed in the mount hole 49 of the connecting member 4, and is configured as a barrel that opens toward the first shaft member 6. A surrounding wall segment of the seat member 80 is formed with a through channel 802.

The abutment member 82 is disposed in the connecting member 4, is movable relative to the seat member 80 along a third axis (Z) that is perpendicular to the first axis (X), and includes a main body 820 and an abutment ring 824. The main body 820 is configured as a barrel that opens toward the seat member 80, that partially extends into the seat member 80, and that partially extends into the shaft hole 43. The main body 820 has an abutment surface 821 that faces the cam portion 62 of the first shaft member 6, a communicating hole 825 that is formed through an upper end wall segment thereof and through the abutment surface 821, and at least one communicating groove 822 that is formed in the abutment surface 821 and that communicates spatially the communicating hole 825. In this embodiment, the abutment surface 821 is a concave surface. The abutment ring 824 is disposed in the main body 820, and is formed with a communicating hole 826 therthrough. The abutment ring 824 and the upper end wall segment of the main body 820 cooperatively define a communicating channel 823 therebetween.

The resilient member 81 is disposed in the seat member 80, and is connected to the abutment member 82 for biasing resiliently the abutment member 82 toward the first shaft member 6, such that the abutment surface 821 abuts against the cam portion 62 of the first shaft member 6.

The check valve 83 is disposed in the communicating channel 823, and includes a valve member 831 and a resilient member 832. In this embodiment, the valve member 831 is configured to be spherical. The resilient member 832 is connected to the valve member 831 for biasing resiliently the valve member 831 toward the abutment ring 824 to seal releasably the communicating hole 826 of the abutment ring 824.

The barrel sealing rings 84 are sleeved on an outer surrounding surface of the main body 820 of the abutment member 82 for sealing a gap between the abutment member 82 and the seat member 80. The seat sealing rings 85, 86 are sleeved on an outer surrounding surface of the seat member 80 for sealing a gap between the seat member 80 and the connecting member 4. The channel sealing ring 87 is sleeved on an outer surrounding surface of the abutment ring 824 for sealing a gap between the abutment ring 824 and an inner surrounding surface of the main body 820 of the abutment member 82.

Figure 6:
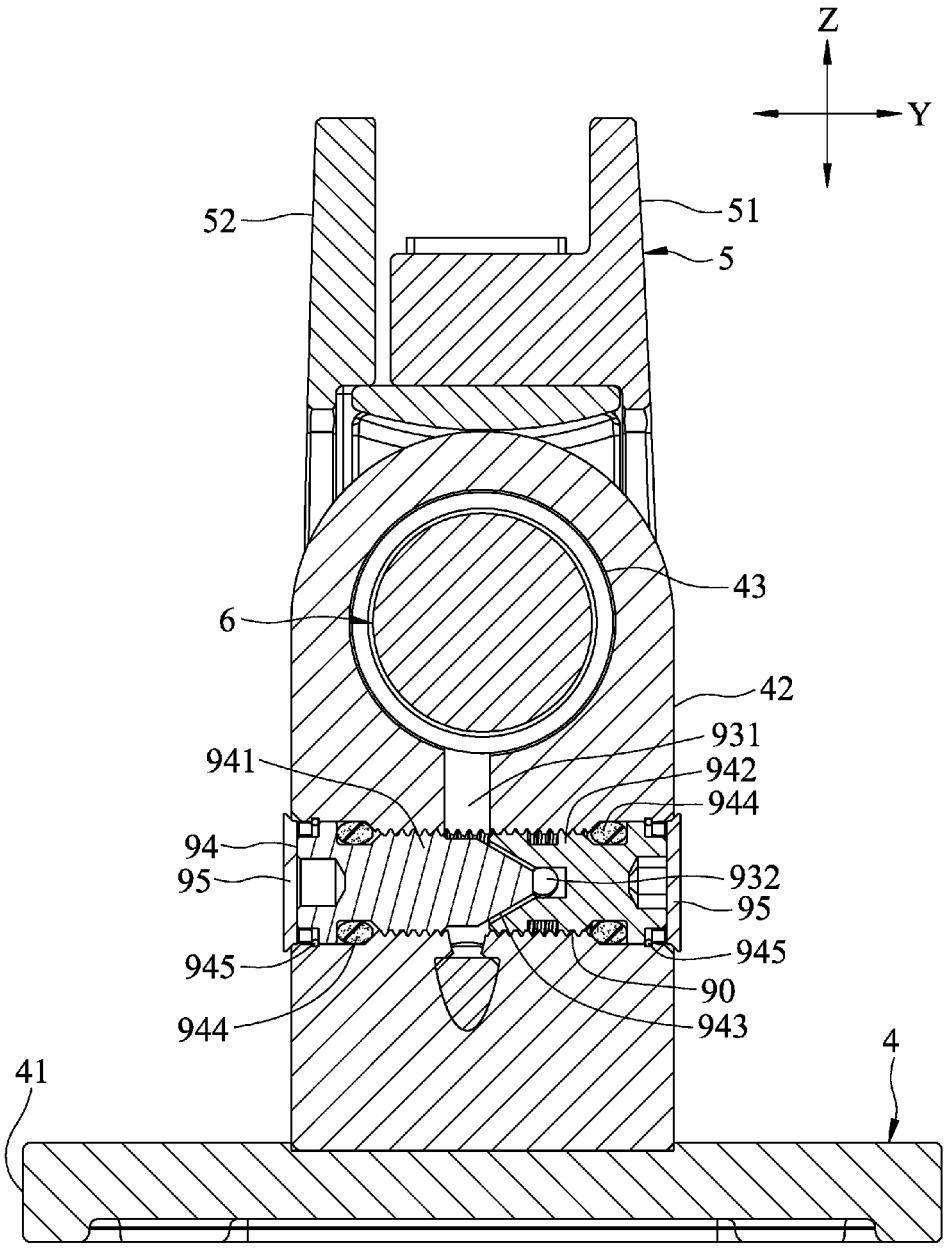
FIG. 6 is another sectional view of the first embodiment taken along line VI-VI in FIG. 3.

Referring to FIGS. 2, 4 and 6, the damping unit 9 includes a through hole 90, a first chamber 91, a second chamber 92, a first fluid channel 931, a second fluid channel 932, a throttle valve unit 94 and a pair of end caps 95.

The through hole 90 is formed through the mount portion 42 of the connecting member 4, and extends in the direction of the second axis (Y). The through hole 90 has two threaded portions that are spaced apart from each other in the direction of the second axis (Y), and a central portion that is disposed between the threaded portions.

The first and second chambers 91, 92 are defined respectively at opposite sides of the abutment member 82, and are filled with damping oil. In detail, the first chamber 91 is a part of the shaft hole 43, and terminates at the abutment surface 821 of the main body 820 of the abutment member 82. The second chamber 92 is defined between the abutment ring 824 and a lower end wall segment of the seat member 80. The cam portion 62 of the first shaft member 6 is disposed in the first chamber 91. The first chamber 91 communicates fluidly with the communicating channel 823 via the communicating hole 825. The second chamber 92 communicates fluidly with the communicating channel 823 via the communicating hole 826. The volume of each of the first and second chambers 91, 92 varies in response to the movement of the abutment member 82 relative to the connecting member 4 along the third axis (Z).

The first fluid channel 931 is formed in the connecting member 4, and communicates fluidly with the first chamber 91 and the central portion of the through hole 90. The second fluid channel 932 is formed in the connecting member 4, communicates fluidly with the central portion of the through hole 90, and communicates fluidly with the second chamber 92 via the through channel 802 of the seat member 80.

The throttle valve unit 94 includes two valve members 941, 942, two valve sealing rings 944 and two C-shaped limiting members 945. Each of the valve members 941, 942 is threaded drivingly into a respective one of the threaded portions of the through hole 90, and has an interior end portion proximate to the other one of the valve members 941, 942, and an exterior end portion distal from the other one of the valve members 941, 942. The interior end portions of the valve members 941, 942 respectively have a conical projection and a conical recess that cooperatively define a communicating gap 943 therebetween communicating fluidly with the first and second fluid channels 931, 932 (i.e., the communicating gap 943 is a part of the central portion of the through hole 90). The dimension of the communicating gap 943 is adjustable by driving at least one of the valve members 941, 942 to move along the through hole 90. Each of the valve sealing rings 944 is sleeved on an outer surface of a respective one of the valve members 941, 942 for sealing a gap between the through hole 90 and the respective one of the valve members 941, 942. Each of the C-shaped limiting members 945 is installed in the through hole 90 near the exterior end portion of a respective one of the valve members 941, 942 for preventing the respective one of the valve members 941, 942 from disengaging from the through hole 90.

The end caps 95 respectively block opposite ends of the through hole 90 to respectively cover the valve members 941, 942.

Figure 7:
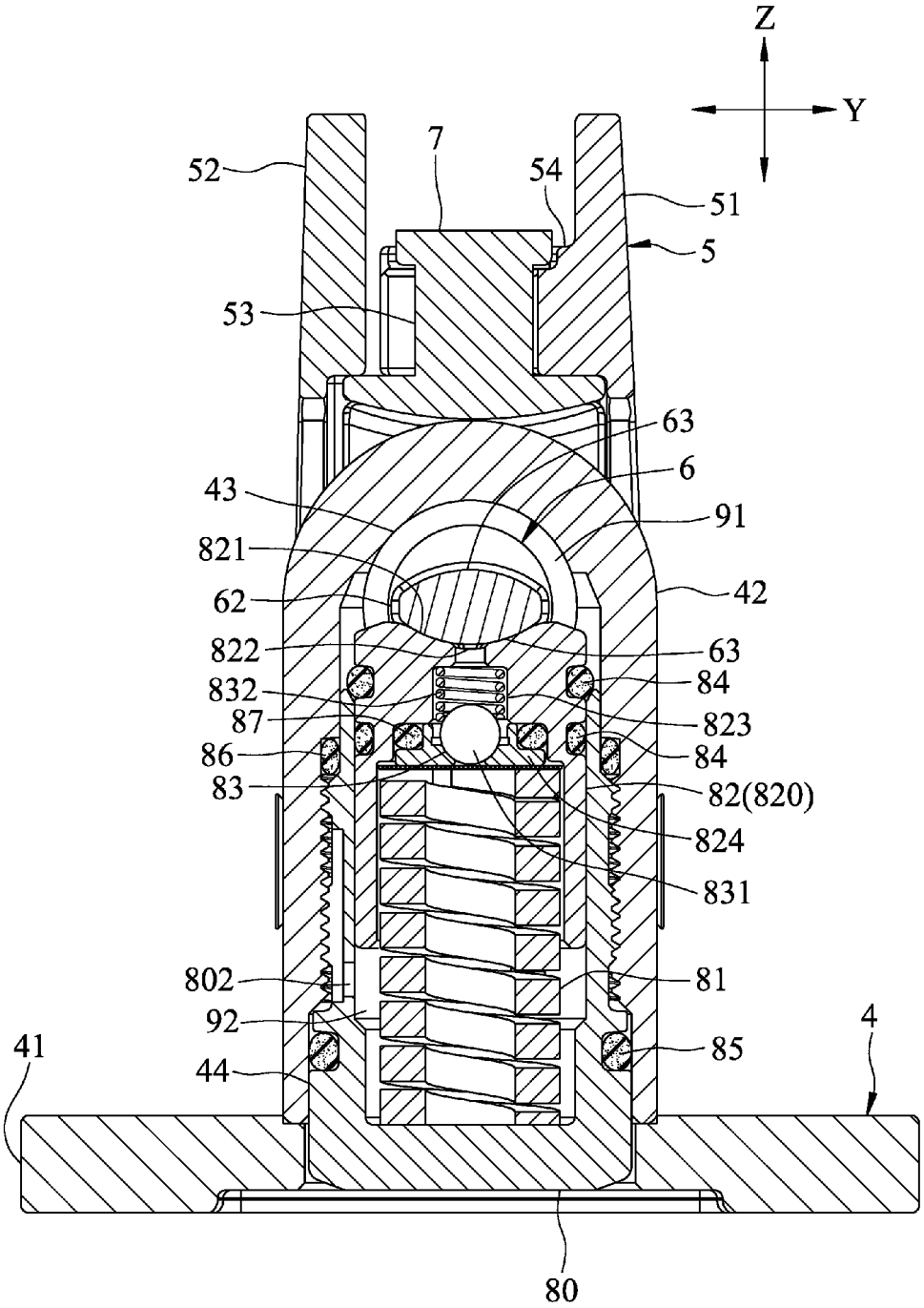
FIG. 7 is still another sectional view of the first embodiment taken along line VII-VII in FIG. 3.

Referring to FIG. 7, when the pivoting member 5 is at the normal position, the first shaft member 6 is at a neutral position where one of the cam surfaces 63 engages complementally the abutment surface 821 of the abutment member 82. It is noted that fluid communication between the first chamber 91 and the second chamber 92 is closed when the first shaft member 6 is at the neutral position.

Figure 8:
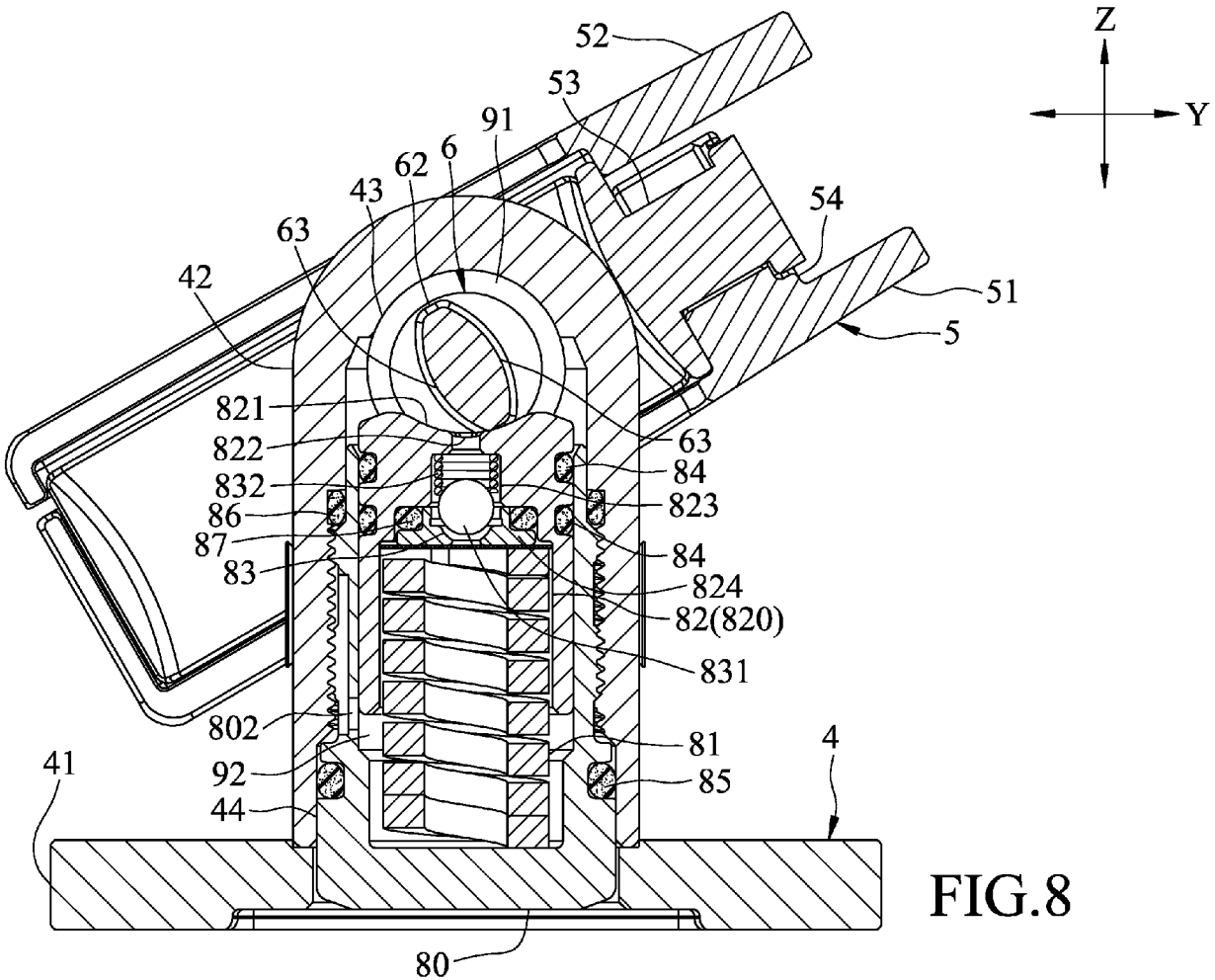
FIG. 8 is a schematic sectional view of the first embodiment.
Figure 9:
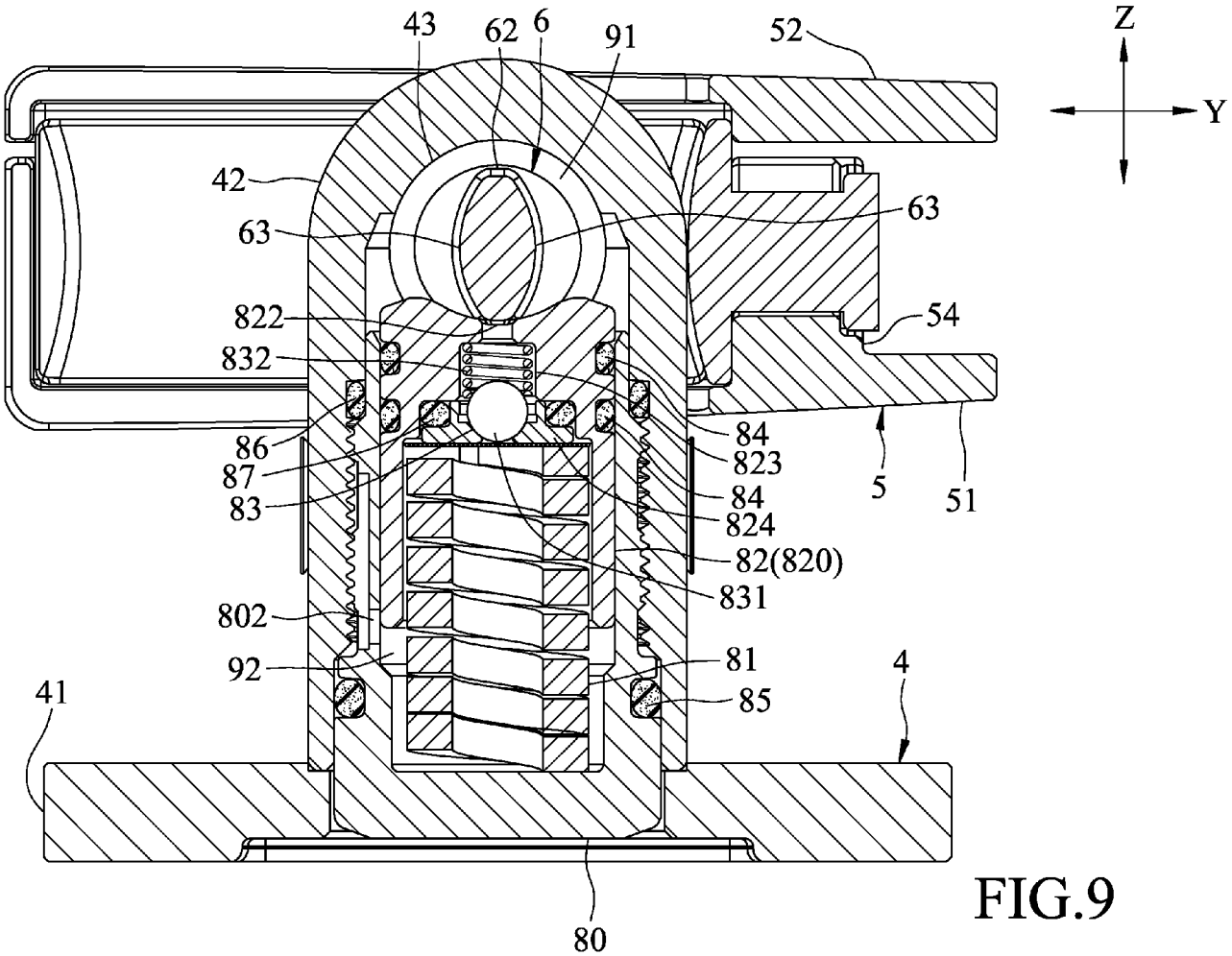
FIG. 9 is another schematic sectional view of the first embodiment.

Referring further to FIGS. 8 and 9, when the pivoting member 5 is driven by an external force to pivot relative to the connecting member 4 from the normal position toward the ultimate position, the first shaft member 6 is simultaneously driven to rotate away from the neutral position. With the rotation of the cam portion 62 of the first shaft member 6, the abutment member 82 is pushed by the one of the cam surfaces 63 to move away from the first shaft member 6 against the biasing force of the resilient member 81 to enlarge the first chamber 91 and to shrink the second chamber 92.

The damping oil in the shrunk second chamber 92 generates a retarding force for retarding the rotation of the first shaft member 6, and is forced to flow toward the first chamber 91 via two paths. A portion of the damping oil in the shrunk second chamber 92 pushes the valve member 831 of the check valve 83 against the resilient force of the resilient member 832 to unblock the communicating hole 826, and flows through the communicating hole 826, the communicating channel 823, the communicating hole 825 and the communicating groove 822 into the first chamber 91. Another portion of the damping oil in the shrunk second chamber 92 flows through the through channel 802, the second fluid channel 932, the communicating gap 943 and the first fluid channel 931 into the first chamber 91.

When the external force is removed, the abutment member 82 is driven by the resilient member 81 to move toward the first shaft member 6 to press against the one of the cam surfaces 63, so as to drive rotation of the first shaft member 6 back to the neutral position, and to therefore drive the pivoting member 5 to pivot toward the normal position. The movement of the abutment member 82 directed toward the first shaft member 6 enlarges the second chamber 92 and shrinks the first chamber 91. The damping oil in the shrunk first chamber 91 generates a retarding force for retarding the movement of the abutment member 82 directed toward the first shaft member 6, and is forced to flow toward the second chamber 92 via only one path since the valve member 831 of the check valve 83 is configured to be pushed to unblock the communicating hole 826 unilaterally (i.e. the check valve 83 prevents the damping oil from flowing from the first chamber 91 into the second chamber 92 through the communicating channel 823). A portion of the damping oil in the shrunk first chamber 91 flows through the first fluid channel 931, the communicating gap 943, the second fluid channel 932 and the through channel 802 into the second chamber 92. It is noted that, since the dimension of the communicating gap 943 is adjustable by driving at least one of the valve members 941, 942 to move along the through hole 90, the flow rate of the damping oil flowing through the communicating gap 943 can be thereby adjusted, so as to determine the rotating speed of the first shaft member 6 when the first shaft member 6 is driven by the resilient member 81 to rotate back to the neutral position.

Referring to FIGS. 5 and 6, since the shaft sealing rings 64 seal the gap between one of the connecting portions 65 and the inner surrounding surface of the connecting member 4 that defines the shaft hole 43 and the gap between the other one of the connecting portions 65 and the inner surrounding surface, and the barrel sealing rings 84 seal a gap between the abutment member 82 and the seat member 80, the damping oil in the first chamber 91 is prevented from leakage via the abovementioned gaps. The seat sealing ring 85 seals the gap between the seat member 80 and the connecting member 4 and is disposed at one side of the through channel 802 to prevent the damping oil flowing through the through channel 802 from leaking into the first chamber 91. The seat sealing ring 86 seals the gap between the seat member 80 and the connecting member 4 and is disposed at an opposite side of the through channel 802 opposite to the seat sealing ring 85 to prevent the damping oil flowing through the through channel 802 from leaking out of the connecting member 4. The channel sealing ring 87 seals the gap between the abutment ring 824 and the inner surrounding surface of the main body 820 of the abutment member 82 to ensure the function of the check valve 83.

Figure 10:
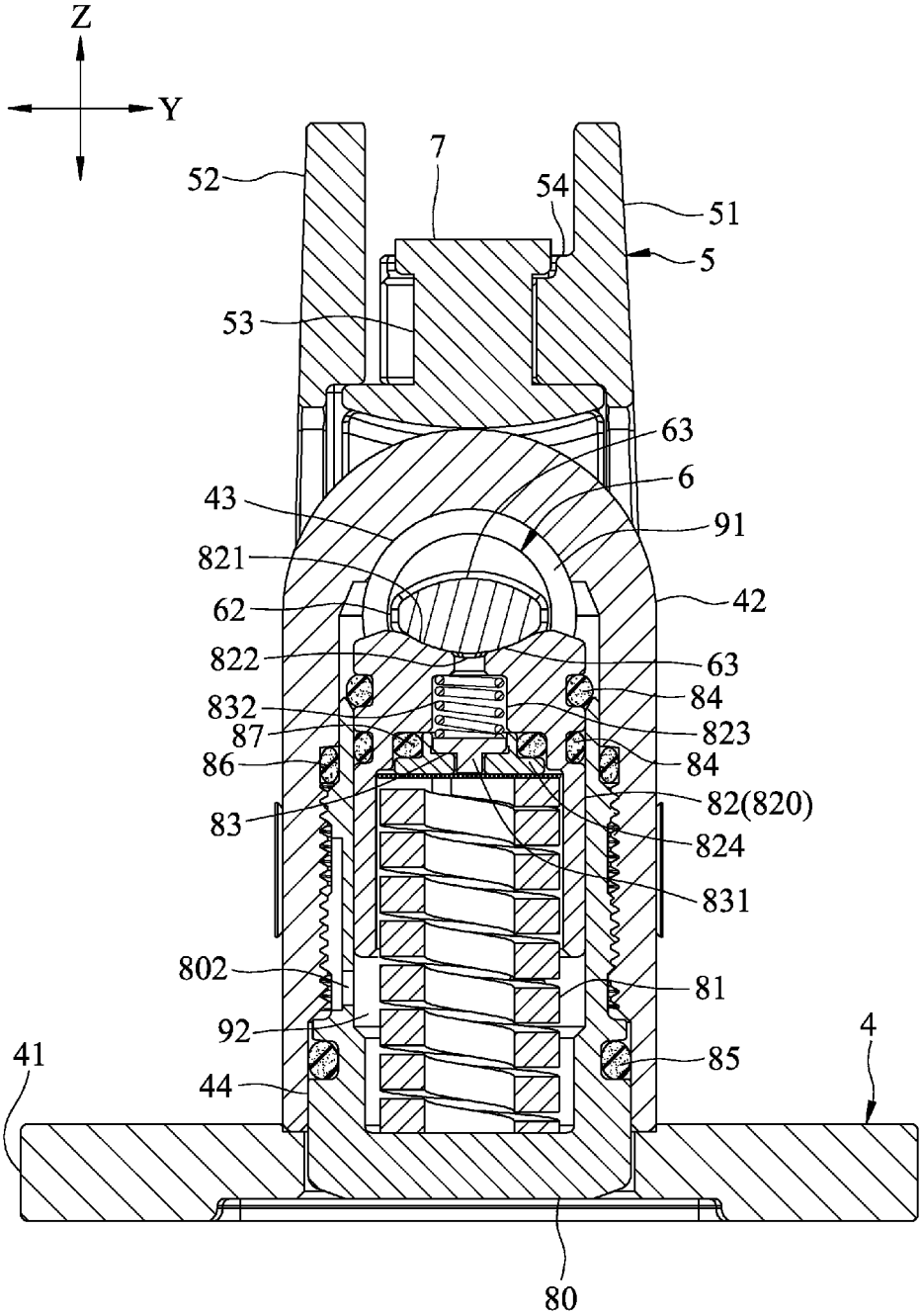
FIG. 10 is a sectional view of a variation of the first embodiment.
Figure 11:
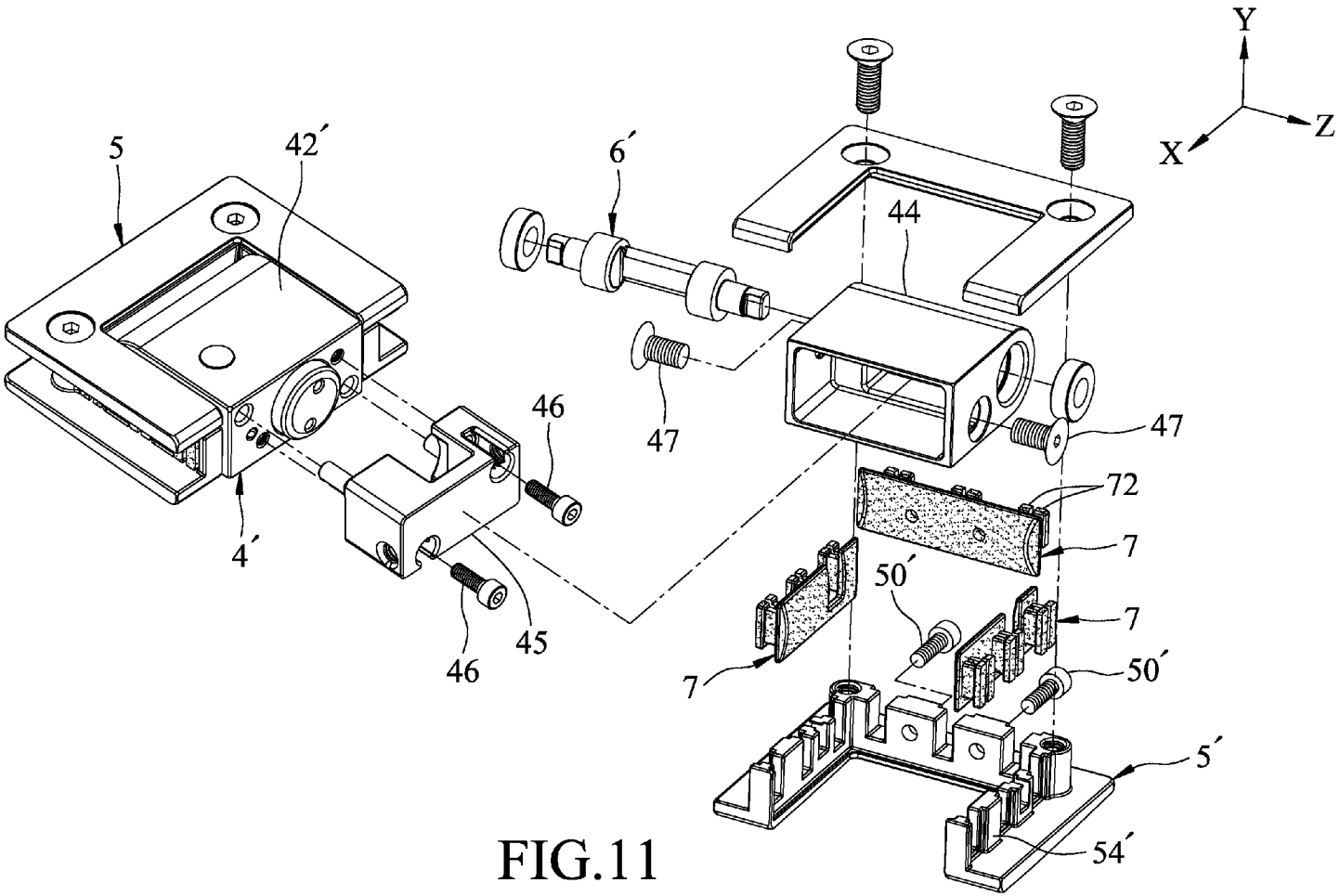
FIG. 11 is an exploded perspective view of a second embodiment of the hinge according to the invention.
Figure 12:
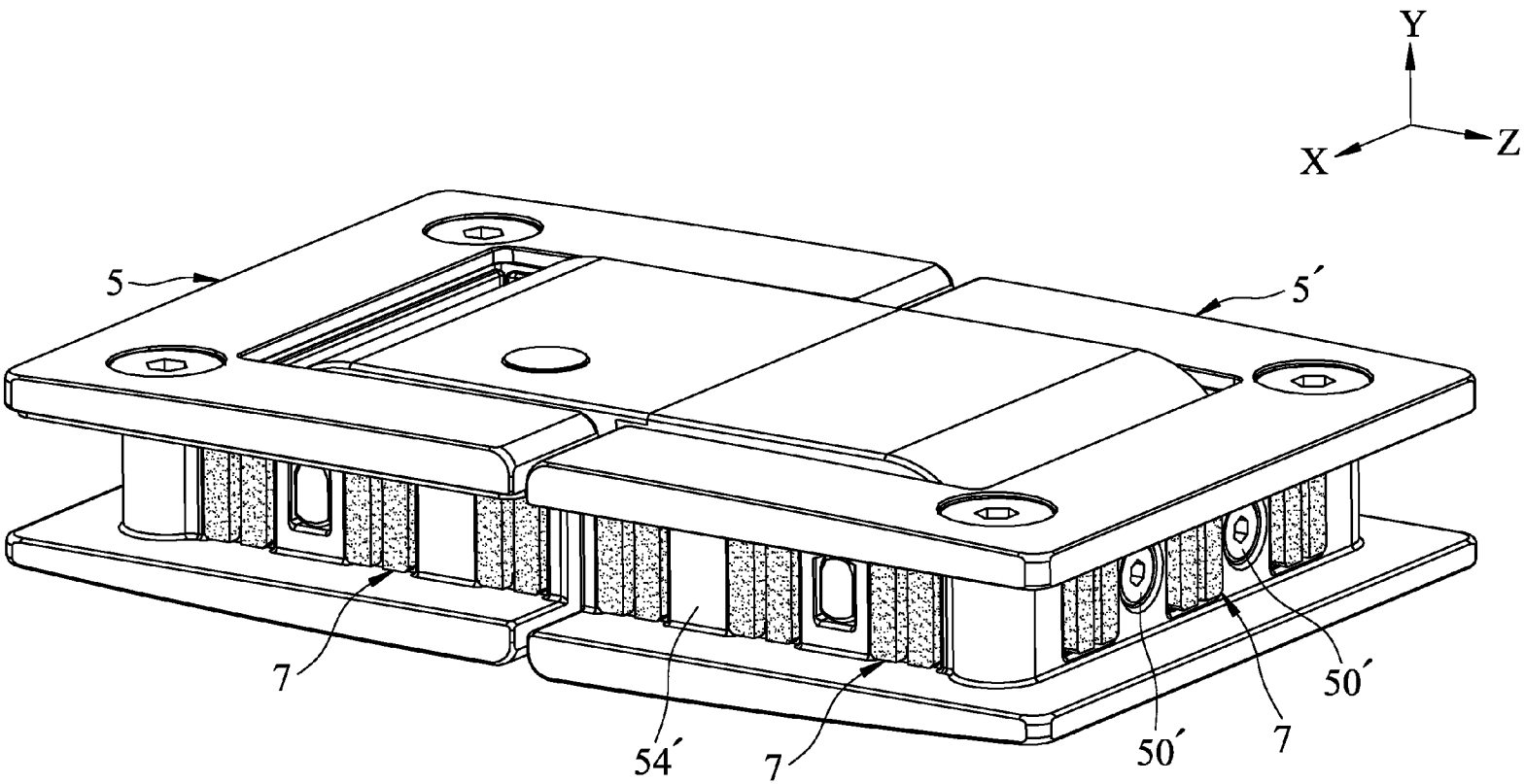
FIG. 12 is a perspective view of the second embodiment.
Figure 13:
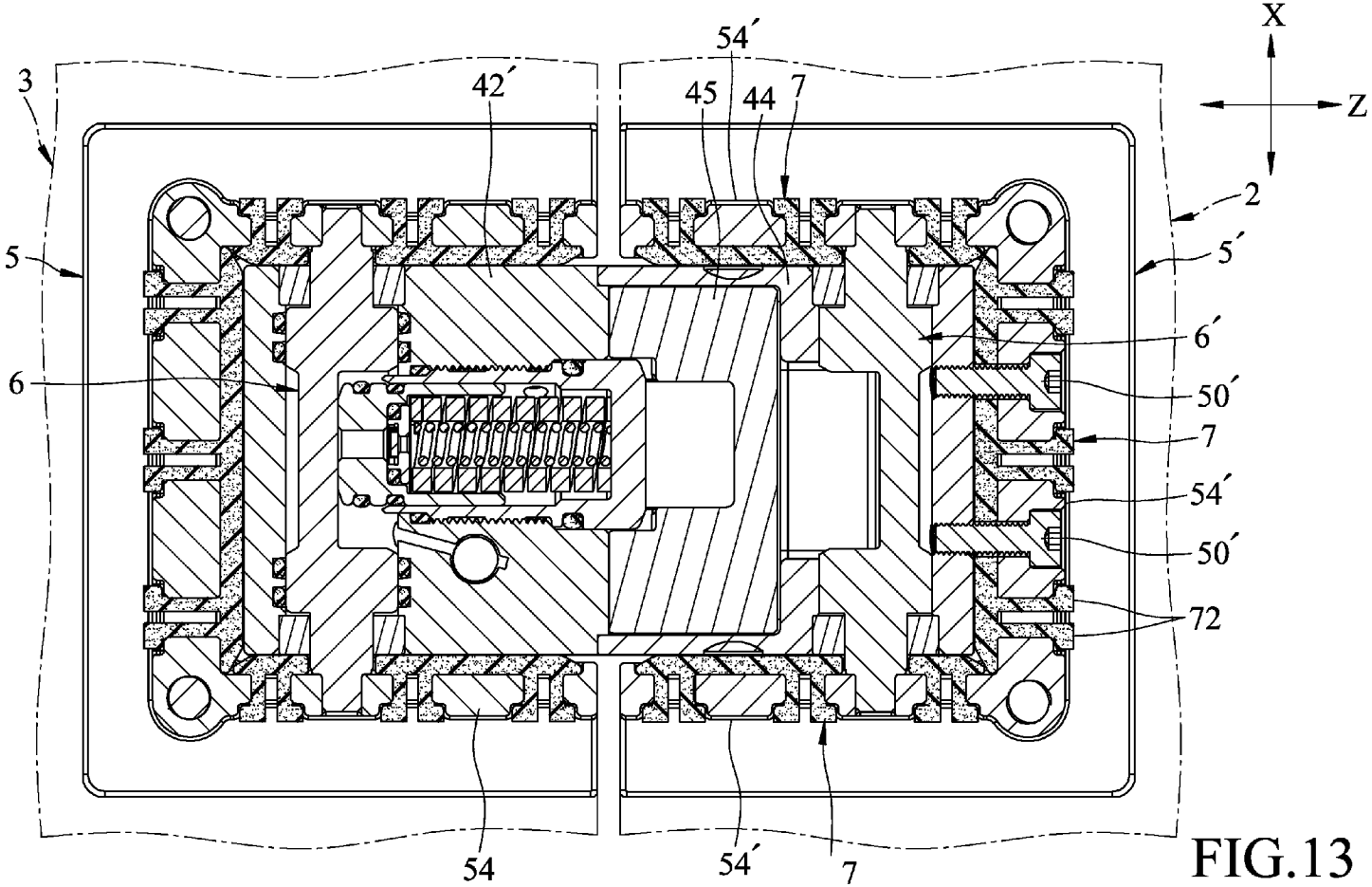
FIG. 13 is a schematic sectional view of the second embodiment.
Figure 14:
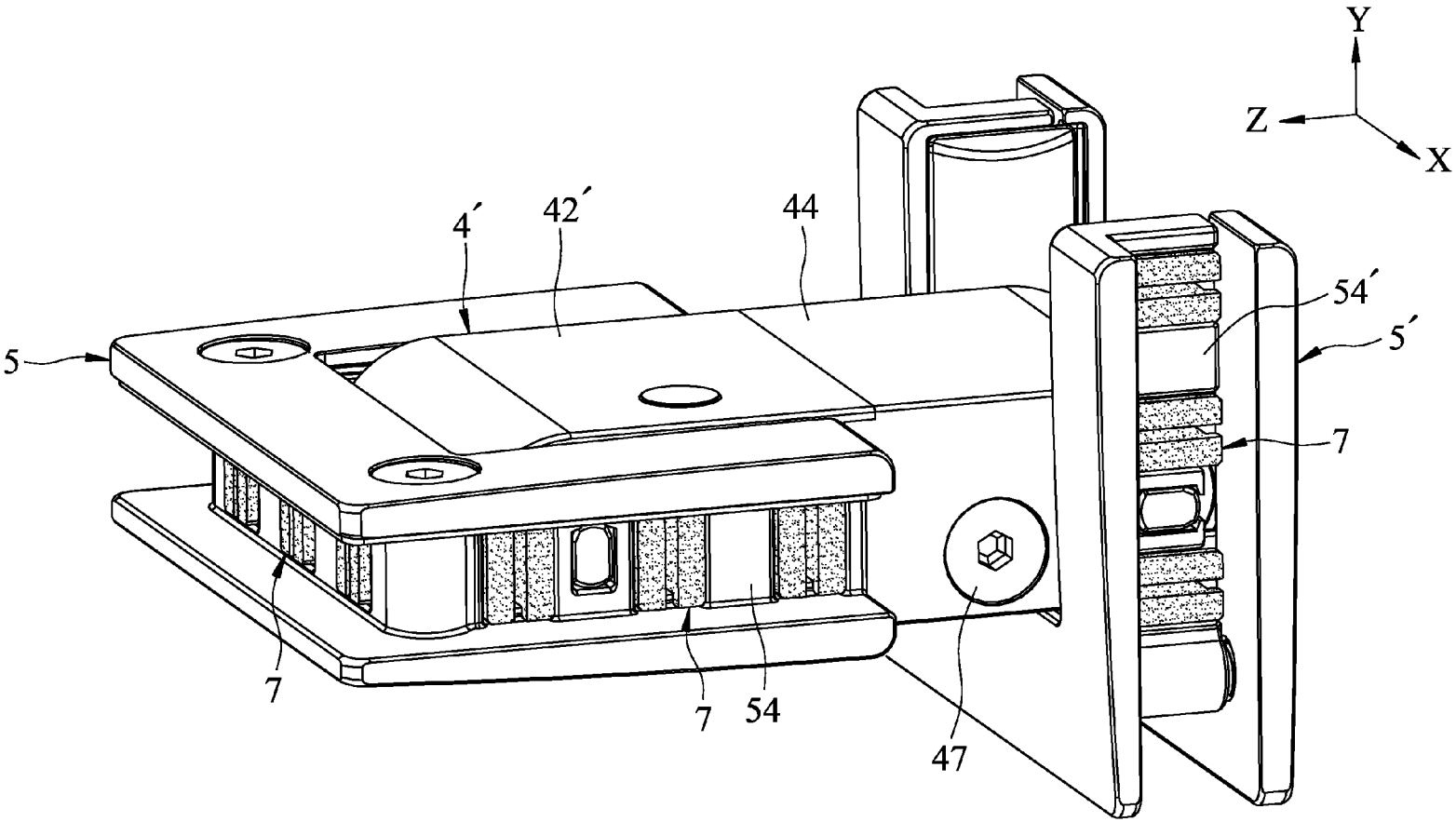
FIG. 14 is a schematic perspective view of the second embodiment.

Referring to FIG. 10, the valve member 831 of the check valve 83 of a variation of the first embodiment is configured as a mushroom valve, and functions like the spherical one.

Referring to FIGS. 11 to 14, a second embodiment of the hinge according to the present invention further includes an engaging member 5', a second shaft member 6', two positioning bolts 50' and three additional cushion members 7. In this embodiment, the first object 2 is configured as a door panel.

The connecting member 4' includes a first mounting seat 42' for extension of the first shaft member 6, a base seat 45, a plurality of first bolts 46 extending in the direction of the third axis (Z) through the base seat 45 and engaging threadedly with the first mounting seat 42' for connecting the base seat 45 removably to the first mounting seat 42', a second mounting seat 44 having a retaining space for retaining the base seat 45, and a plurality of second bolts 47 extending in the direction of the first axis (X) through the second mounting seat 44 and engaging threadedly with the base seat 45 for connecting the second mounting seat 44 removably to the base seat 45.

The second shaft member 6' is similar to the first shaft member 6, and extends rotatably through the second mounting seat 44.

The engaging member 5' is similar to the pivoting member 5, is connected co-rotatably to the second shaft member 6', and has three limiting surfaces 54'. The positioning bolts 50' extend in the direction of the third axis (Z) through the engaging member 5' and engage threadedly with second mounting seat 44, such that, in general use, the engaging member 5' is not rotatable relative to the second mounting seat 44.

The additional cushion members 7 are mounted fixedly to the engaging member 5'. Each of the additional cushion members 7 has a plurality of cushion segments 72. Each of the cushion segments 72 has a portion that protrudes out of a corresponding one of the limiting surfaces 54' to serve as a shock absorber, so as to prevent collision between the engaging member 5' and the first object 2.

In disassembly of the second mounting seat 44 from the base seat 45, the positioning bolts 50' are first disengaged from the second mounting seat 44, such that the engaging member 5' and the second shaft member 6' can be rotated relative to the second mounting seat 44 to expose the second bolts 47. Consequently, the second bolts 47 can be disengaged from the base seat 45, and the second mounting seat 44 can be therefore removed from the base seat 45.

The advantages of the hinge according to this invention are as follows.

1. The cushion members 7 prevent the collision between the pivoting member 5 and the second object 3 (and the collision between the engaging member 5 and the first object 2) when the second object 3 is driven to rotate, and therefore enhance safety of the operation of the second object 3 (and the first object 2) and lengthen the service life of the second object 3 (and the first object 2).

2. Each of the end portions 61 of the first shaft member 6 has a rectangular cross-section, and is riveted or soldered to the pivoting member 5 after being inserted fittingly into the respective one of the rectangular insertion holes 55, such that the first shaft member 6 and the pivoting member 5 are coupled securely and would not be loosed during use of the hinge.

3. The presence of the communicating groove 822 reduces the contact surface area between the abutment surface 821 and the one of the cam surfaces 63, so as to reduce the dynamic friction between the first shaft member 6 and the abutment member 82, and to smooth the relative movement between the first shaft member 6 and the abutment member 82.

4. Since the dimension of the communicating gap 943 is adjustable by driving either one of the valve members 941, 942 to move along the through hole 90, the flow rate of the damping oil flowing through the communicating gap 943 can be adjusted from two opposite sides of the hinge along the second axis (Y). Therefore, it is easy to adjust the flow rate of the damping oil flowing through the communicating gap 943 wherever the hinge is placed.

5. By the configuration of the through hole 90, the shaft hole 43 and the mount hole 49, the first and second fluid channels 931, 932 are easily machined via the shaft hole 43 and the mount hole 49. Moreover, the threaded engagement between each of the valve members 941, 942 and the through hole 90 prevents the valve member 941, 942 from moving along the through hole 90 without being rotated, such that the flow rate of the damping oil flowing through the communicating gap 943 can be controlled more precisely.

While the present invention has been described in connection with what are considered the most practical embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A hinge adapted for interconnecting first and second objects, comprising:

a connecting member adapted to be connected to the first object;

a first shaft member extending along a first axis and through said connecting member, and rotatable relative to said connecting member about the first axis;

a pivoting member connected co-rotatably to said first shaft member to be pivotable relative to said connecting member, and adapted to be connected to the second object so that the second object is pivotable relative to the first object, said pivoting member having at least one limiting surface that faces the second object;

at least one shock absorber adapted to be disposed between said limiting surface of said pivoting member and the second object for preventing collision between said pivoting member and the second object; and a restoring unit disposed in said connecting member for driving rotation of said first shaft member toward a neutral position, so as to maintain said pivoting member at a normal position relative to said connecting member;

wherein said pivoting member further has a main engaging portion that is adapted to engage an engaging portion of the second object and that has said limiting surface, and at least one installation groove that is formed through said main engaging portion; and wherein said hinge further comprises at least one cushion member that is made of shock absorb material, and that has a base segment disposed at one side of said main engaging portion that is opposite to said limiting surface, and abutting against said main engaging portion, a pair of spaced-apart resilient arms extending from said base segment and through said installation groove, and a pair of cushion segments extending respectively from distal ends of said resilient arms and away from each other, and abutting against said main engaging portion such that said cushion member engages fixedly said installation groove in said main engaging portion of said pivoting member, each of said cushion segments having a portion that protrudes out of said limiting surface to serve as said shock absorber.

2. The hinge as claimed in claim 1, wherein:

said main engaging portion of said pivoting member is U-shaped, opens away from the second object, and has a pair of side sections that are spaced apart from each other along the first axis, and a connecting section that interconnects said side sections, each of said side sections and said connecting section having one said limiting surface that faces the second object; and said hinge comprises three said cushion members, each of said cushion members engaging a respective one of said side sections and said connecting section, and having a plurality of pairs of cushion segments that partially protrude out of a corresponding one of said limiting surfaces.

3. The hinge as claimed in claim 2, wherein said pivoting member further has two spaced-apart plate portions that are connected respectively to opposite sides of said main engaging portion along a second axis perpendicular to the first axis, and that cooperatively clamp the engaging portion of the second object therebetween.

4. The hinge as claimed in claim 3, wherein:

said main engaging portion of said pivoting member is formed with two non-circular insertion holes; and said first shaft member has two opposite end portions that are disposed along the first axis, each of said end portions being inserted fittingly into a respective one of said insertion holes.

5. The hinge as claimed in claim 1, wherein:

said connecting member has a base portion that is adapted to be connected to the first object, and a mount portion that extends from said base portion and away from the first object;

said first shaft member has two opposite end portions that are disposed along the first axis and out of the mount portion, and a cam portion that is disposed in said mount portion and between said end portions, and that has a cam surface; and said restoring unit includes an abutment member that is disposed movably between said first shaft member and said base portion of said connecting member, and that has an abutment surface facing said first shaft member, and a resilient member that is connected to said abutment member for biasing resiliently said abutment member toward said cam portion of said first shaft member such that said abutment surface abuts against said cam portion of said first shaft member, said abutment surface engaging complementally said cam surface when said first shaft member is at the neutral position, said abutment member being pushed by said cam surface to move away from said first shaft member against the biasing force of said resilient member when said first shaft member is driven by an external force to rotate away from the neutral position, said abutment member being driven by said resilient member to move toward said first shaft member to press against said cam surface, so as to drive rotation of said first shaft member toward the neutral position when the external force is removed.

6. A hinge adapted for interconnecting first and second objects, comprising:

a connecting member adapted to be connected to the first object;

a first shaft member extending along a first axis and through said connecting member, and rotatable relative to said connecting member about the first axis;

a pivoting member connected co-rotatably to said first shaft member to be pivotable relative to said connecting member, and adapted to be connected to the second object so that the second object is pivotable relative to the first object, said pivoting member having at least one limiting surface that faces the second object;

at least one shock absorber adapted to be disposed between said limiting surface of said pivoting member and the second object for preventing collision between said pivoting member and the second object;

a restoring unit disposed in said connecting member for driving rotation of said first shaft member toward a neutral position, so as to maintain said pivoting member at a normal position relative to said connecting member;

an engaging member connected to said connecting member, the first object being connected to said engaging member, said engaging member having a limiting surface that faces of the first object;

a second shaft member connected fixedly to said engaging member and extending through said connecting member; and two said shock absorbers respectively disposed between said limiting surface of said pivoting member and the second object and between said limiting surface of said engaging member and the first object.

7. The hinge as claimed in claim 6, wherein said connecting member includes a first mounting seat for extension of said first shaft member, a base seat, at least one first bolt extending through said base seat and engaging threadedly with said first mounting seat for connecting said base seat removably to said first mounting seat, a second mounting seat having a retaining space for retaining said base seat, said second shaft member extending through said second mounting seat, and at least one second bolt extending through said second mounting seat and engaging threadedly with said base seat.

8. A hinge adapted for interconnecting first and second objects, comprising:

a connecting member adapted to be connected to the first object;

a first shaft member extending along a first axis and through said connecting member, and rotatable relative to said connecting member about the first axis;

a pivoting member connected co-rotatably to said first shaft member to be pivotable relative to said connecting member, and adapted to be connected to the second object so that the second object is pivotable relative to the first object, said pivoting member having at least one limiting surface that faces the second object;

at least one shock absorber adapted to be disposed between said limiting surface of said pivoting member and the second object for preventing collision between said pivoting member and the second object; and a restoring unit disposed in said connecting member for driving rotation of said first shaft member toward a neutral position, so as to maintain said pivoting member at a normal position relative to said connecting member;

wherein said connecting member has a base portion that is adapted to be connected to the first object, and a mount portion that extends from said base portion and away from the first object;

said first shaft member has two opposite end portions that are disposed along the first axis and out of the mount portion, and a cam portion that is disposed in said mount portion and between said end portions, and that has a cam surface;

wherein said restoring unit includes an abutment member that is disposed movably between said first shaft member and said base portion of said connecting member, and that has an abutment surface facing said first shaft member, and a resilient member that is connected to said abutment member for biasing resiliently said abutment member toward said cam portion of said first shaft member such that said abutment surface abuts against said cam portion of said first shaft member, said abutment surface engaging complementally said cam surface when said first shaft member is at the neutral position, said abutment member being pushed by said cam surface to move away from said first shaft member against the biasing force of said resilient member when said first shaft member is driven by an external force to rotate away from the neutral position, said abutment member being driven by said resilient member to move toward said first shaft member to press against said cam surface, so as to drive rotation of said first shaft member toward the neutral position when the external force is removed; and said hinge further comprises a damping unit including first and second chambers that are formed in said connecting member, that are filled with damping oil, and that are defined respectively at opposite sides of said abutment member of said restoring unit, said cam portion of said first shaft member being disposed in said first chamber, at least one fluid channel that is formed in said connecting member, and that communicates fluidly with said first and second chambers, the damping oil flowing between said first and second chambers via said fluid channel in response to the movement of said abutment member for damping the rotation of said first shaft member, and at least one communicating groove that is formed in one of said cam surface of said first shaft member and said abutment surface of said abutment member, and that retains damping oil when said first shaft member is at the neutral position.

9. The hinge as claimed in claim 8, wherein said restoring unit further includes a seat member mounted in said connecting member and configured as a barrel that opens toward said abutment member, said abutment member partially extending into said seat member, and cooperating with said seat member to define said second chamber therebetween, at least one barrel sealing ring sleeved on an outer surrounding surface of said abutment member for sealing a gap between said abutment member and said seat member, and at least one seat sealing ring sleeved on an outer surrounding surface of said seat member for sealing a gap between said seat member and said connecting member.

10. The hinge as claimed in claim 8, wherein said communicating grooves are formed in said abutment surface of said abutment member, said cam surface of said first shaft member being convex, said abutment surface of said abutment member being concave.

11. The hinge as claimed in claim 8, wherein said restoring unit further includes a communicating channel that is formed in said abutment member, and that communicates fluidly with said first and second chambers, a check valve that is provided in said abutment member, and that includes a valve member, and a resilient member biasing resiliently said valve member to releasably seal said communicating channel, said check valve permitting the damping oil to flow from said second chamber into said first chamber through said communicating channel, and preventing the damping oil from flowing from said first chamber into said second chamber through said communicating channel.

12. The hinge as claimed in claim 8, wherein said damping unit further includes a through hole that is formed through said mount portion of said connecting member, and that has a central potion communicating fluidly with said fluid channel and two threaded portions disposed respectively at two opposite side of said central portion, and a throttle valve unit that includes two valve members threaded drivingly and respectively into said threaded portions of said through hole, and that cooperatively define a communicating gap therebetween communicating fluidly with said fluid channel, the dimension of said communicating gap being adjustable by driving at least one of said valve members to move along said through hole, so as to adjust the flow rate of the damping oil flowing through said communicating gap.

* * * * *